US010186785B2

(12) United States Patent
You et al.

(10) Patent No.: US 10,186,785 B2
(45) Date of Patent: Jan. 22, 2019

(54) ANTENNA SYSTEM

(71) Applicant: Wistron NeWeb Corp., Hsinchu (TW)

(72) Inventors: Shang-Sian You, Hsinchu (TW); Yu Tao, Hsinchu (TW); Tsun-Che Huang, Hsinchu (TW); Cheng-Geng Jan, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 269 days.

(21) Appl. No.: 15/201,996

(22) Filed: Jul. 5, 2016

(65) Prior Publication Data

US 2017/0214147 A1 Jul. 27, 2017

(30) Foreign Application Priority Data

Jan. 25, 2016 (TW) ..... 105102171 A

(51) Int. Cl.

| | |
|---|---|
| ***H01Q 15/14*** | (2006.01) |
| ***H01Q 15/00*** | (2006.01) |
| ***H01Q 9/40*** | (2006.01) |
| ***H01Q 3/24*** | (2006.01) |
| ***H01Q 1/36*** | (2006.01) |

(52) U.S. Cl.

CPC ..... *H01Q 15/14* (2013.01); *H01Q 1/36* (2013.01); *H01Q 3/242* (2013.01); *H01Q 9/40* (2013.01); *H01Q 15/002* (2013.01)

(58) Field of Classification Search

CPC ..... H01Q 3/242; H01Q 15/14; H01Q 21/205
See application file for complete search history.

(56) References Cited

U.S. PATENT DOCUMENTS

| | | | | |
|---|---|---|---|---|
| 5,479,176 A * | 12/1995 | Zavrel, Jr. | ..... | H01Q 3/242 342/374 |
| 2004/0027304 A1* | 2/2004 | Chiang | ..... | H01Q 1/246 343/810 |
| 2007/0152903 A1* | 7/2007 | Lin | ..... | H01Q 3/242 343/795 |
| 2012/0214425 A1 | 8/2012 | Huang et al. | | |
| 2017/0033471 A1* | 2/2017 | Huang | ..... | H01Q 21/26 |

FOREIGN PATENT DOCUMENTS

TW 200625723 A 7/2006

* cited by examiner

*Primary Examiner* — Daniel Munoz
(74) *Attorney, Agent, or Firm* — McClure, Qualey & Rodack, LLP

(57) ABSTRACT

An antenna system includes a signal source, a plurality of switch elements, a plurality of transmission lines, a plurality of antenna elements, and a plurality of reflectors. The signal source is coupled to a feeding point. The switch elements are selectively closed or opened individually. Each of the antenna elements is coupled through one of the switch elements and one of the transmission lines to the feeding point. Each of the reflectors is configured to reflect an electromagnetic wave from one of the antenna elements.

17 Claims, 8 Drawing Sheets

ANTENNA SYSTEM

CROSS REFERENCE TO RELATED APPLICATIONS

This Application claims priority of Taiwan Patent Application No. 105102171 filed on Jan. 25, 2016, the entirety of which is incorporated by reference herein.

BACKGROUND OF THE INVENTION

Field of the Invention

The disclosure generally relates to an antenna system, and more particularly to a tunable antenna system with high directivity.

Description of the Related Art

With the progress being made in mobile communication technology, mobile devices such as portable computers, mobile phones, multimedia players, and other hybrid functional mobile devices have become more common. To satisfy consumer demands, mobile devices can usually perform wireless communication functions. Some functions cover a large wireless communication area; for example, mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some functions cover a small wireless communication area; for example, mobile phones using Wi-Fi and Bluetooth systems and using frequency bands of 2.4 GHz, 5.2 GHz, and 5.8 GHz.

Wireless access points are indispensable elements for mobile devices in a room to connect to the Internet at a high speed. However, since the indoor environment has serious signal reflection and multipath fading, wireless access points should process signals from a variety of transmission directions simultaneously. Accordingly, it has become a critical challenge for antenna designers to design a narrow-beam, tunable antenna system high directivity in the limited space of a wireless access point.

BRIEF SUMMARY OF THE INVENTION

In a preferred embodiment, the disclosure is directed to an antenna system including a signal source, a plurality of antenna elements, and a plurality of reflectors. The signal source is coupled to a feeding point. The antenna elements cover the same operation frequency band. Each of the antenna elements is coupled through one of a plurality of switch elements and one of a plurality of transmission lines to the feeding point. The switch elements are selectively closed or opened individually. Each of the reflectors is configured to reflect an electromagnetic wave from one of the antenna elements.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Figure 1:
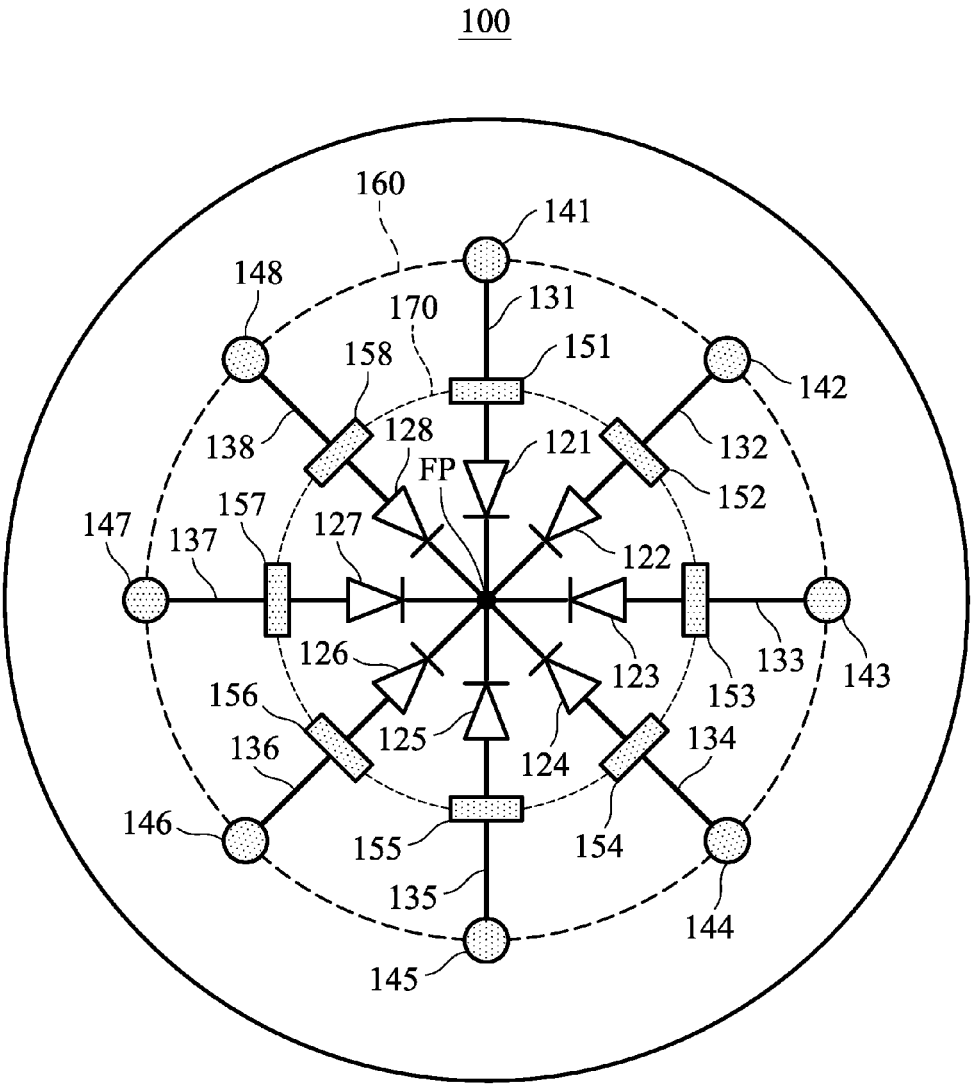
FIG. 1 is a diagram of an antenna system according to an embodiment of the invention.

FIG. 1 is a diagram of an antenna system 100 according to an embodiment of the invention. The antenna system 100 may be applied in a wireless access point and configured to provide a radiation pattern with a narrow main beam. As shown in FIG. 1, the antenna system 100 includes a signal source (not shown), a plurality of switch elements 121, 122, . . . , and 128, a plurality of transmission lines 131, 132, . . . , and 138, a plurality of antenna elements 141, 142, . . . , and 148, and a plurality of reflectors 151, 152, . . . , and 158. It should be noted that in the embodiment of FIG. 1, the total number of antenna elements is 8, the total number of switch elements is 8, the total number of transmission lines is 8, and the total number of reflectors is 8, but in other embodiments, the antenna system 100 may include more or fewer of the aforementioned elements, such as 2, 4, 10, or 12.

The signal source is coupled to a feeding point FP. Each of the antenna elements 141, 142, . . . , and 148 is coupled through the respective one of the switch elements 121, 122, . . . , and 128 and the respective one of the transmission lines 131, 132, . . . , and 138 to the feeding point FP. For example, the antenna element 141 may be coupled through the transmission line 131 and the switch element 121 to the feeding point FP. The transmission lines 131, 132, . . . , and 138 may have the same lengths and the same impedance values, such that the antenna elements 141, 142, . . . , and 148 substantially have the same feeding phases. For example, the feeding phase difference between the antenna elements 141, 142, . . . , and 148 may be from −10 to 10 degrees, and preferably 0 degree. The switch elements 121, 122, . . . , and 128 are selectively closed or opened individually, so as to enable or disable the antenna elements 141, 142, . . . , and 148, respectively. For example, if the switch element 121 is closed, the antenna element 141 may be enabled, and if the switch element 121 is opened, the antenna element 141 may be disabled. In some embodiments, the switch elements 121, 122, . . . , and 128 are closed or opened according to a control signal from a processor. In some embodiments, the switch elements 121, 122, . . . , and 128 are PIN diodes, or are SPST (Single-Pole Single-Throw) switches. Each of the reflectors 151, 152, . . . , and 158 is configured to reflect the electromagnetic wave from the respective one of the antenna elements 141, 142, . . . , and 148, thereby enhancing the directivity of the antenna system 100. For example, the reflector 151 is configured to reflect the back radiation of the antenna element 141, and enhance the forward radiation of the antenna element 141. It should be noted that the reflectors 151, 152, . . . , and 158 are respectively coupled to a ground voltage, and the reflectors 151, 152, . . . , and 158 are independent of the signal transmission paths of the antenna elements 141, 142, . . . , and 148 (each signal transmission path is formed by a respective transmission line and a respective switch element). In some embodiments, the antenna elements 141, 142, . . . , and 148 are spaced at equal intervals around the circumference of a first circle 160, and the reflectors 151, 152, . . . , and 158 are spaced at equal intervals around the circumference of a second circle 170. The diameter of the second circle 170 is slightly shorter than the diameter of the first circle 160. The antenna elements 141, 142, . . . , and 148 can cover the same operation frequency band. For example, the operation frequency band is from 2400 MHz to 2500 MHz, so as to support WLAN (Wireless Local Area Networks) 2.4 GHz and Bluetooth frequency bands.

The detail structure of the antenna system 100 will be described in the embodiments. It should be understood that these embodiments and figures are exemplary, rather restrictions of the invention.

Figure 2:
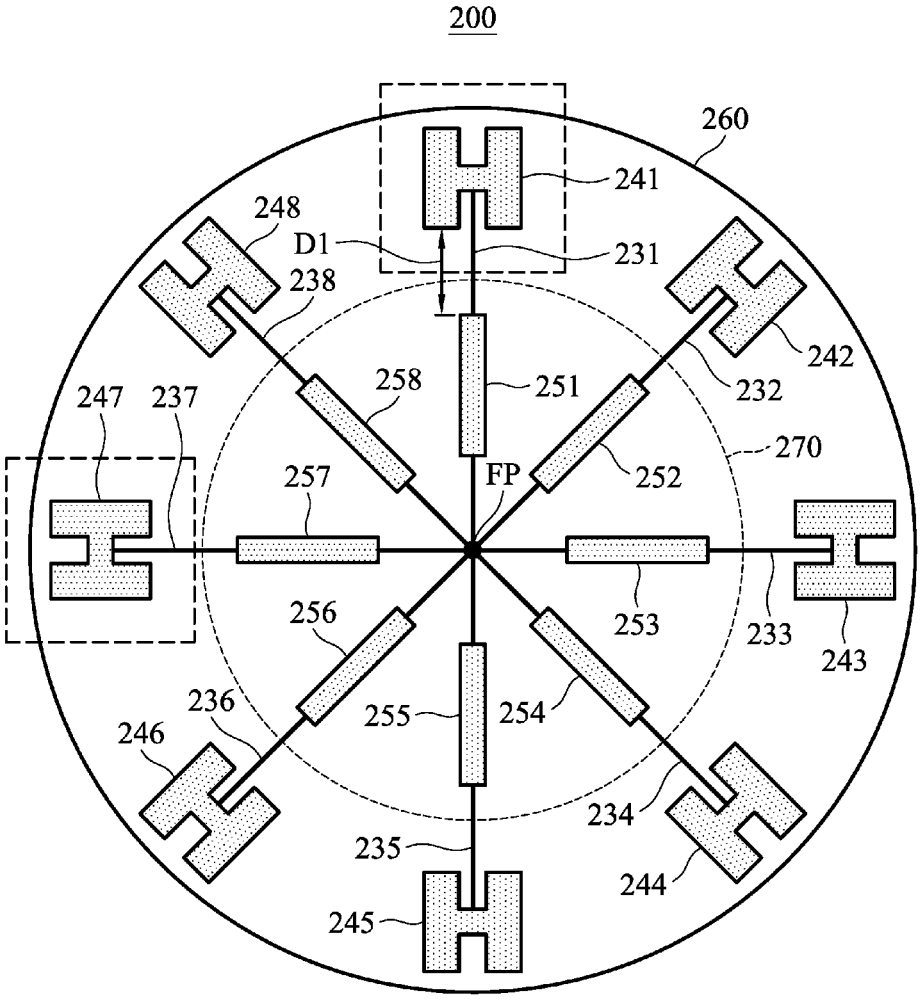
FIG. 2 is a diagram of an antenna system according to an embodiment of the invention.

FIG. 2 is a diagram of an antenna system 200 according to an embodiment of the invention. In the embodiment of FIG. 2, the antenna system 200 includes a signal source (not shown), a plurality of switch elements (not shown), a plurality of transmission lines 231, 232, . . . , and 238, a plurality of antenna elements 241, 242, . . . , and 248, and a plurality of reflectors 251, 252, . . . , and 258. The signal source is coupled to a feeding point FP. Each of the antenna elements 241, 242, . . . , and 248 is coupled through the respective one of the switch elements and the respective one of the transmission lines 231, 232, . . . , and 238 to the feeding point FP. For example, the antenna element 241 may be coupled through a corresponding switch element and the transmission line 231 to the feeding point FP. The switch elements are selectively closed or opened individually, so as to enable or disable the antenna elements 241, 242, . . . , and 248, respectively. The transmission lines 231, 232, . . . , and 238 may have the same lengths and the same impedance values (e.g., each transmission line has an impedance value of 100Ω). Each of the reflectors 251, 252, . . . , and 258 is configured to reflect the electromagnetic wave from the respective one of the antenna elements 241, 242, . . . , and 248. The reflectors 251, 252, . . . , and 258 are respectively coupled to a ground voltage. The reflectors 251, 252, . . . , and 258 are independent of the signal transmission paths of the antenna elements 241, 242, . . . , and 248. As shown in FIG. 2, each of the antenna elements 241, 242, . . . , and 248 has an H-shape, and each of the reflectors 251, 252, . . . , and 258 has a straight-line shape. The antenna elements 241, 242, . . . , and 248 are spaced at equal intervals around the circumference of a first circle 260, and the reflectors 251, 252, . . . , and 258 are spaced at equal intervals around the circumference of a second circle 270. The diameter of the second circle 270 is slightly shorter than the diameter of the first circle 260. Each of the antenna elements 241, 242, . . . , and 248, a corresponding one of the reflectors 251, 252, . . . , 258, and the feeding point FP are aligned in a straight-line. For example, the antenna element 241, the reflector 251, and the feeding point FP may be aligned in a straight line, and the antenna element 242, the reflector and the feeding point FP may be aligned in another straight line. The spacing D1 between each of the reflectors 251, . . . , and 258 and a corresponding one of the antenna elements 241, 242, . . . , and 248 may be ¼ wavelength of the operation frequency band of the antenna system 200. For example, the spacing D1 between the reflector 251 and the antenna element 241 may be ¼ wavelength of the operation frequency band of the antenna system 200, and the spacing D1 between the reflector 252 and the antenna element 242 may also be ¼ wavelength of the operation frequency band of the antenna system 200. In the embodiment of FIG. 2, when the antenna system 200 performs signal transmission or receptions, only two nonadjacent antenna elements of the antenna elements 241, 242, . . . , and 248 are enabled, so as to generate a narrow synthetic radiation beam. For example, only two nonadjacent antenna elements 241 and 247 are enabled, and the other six antenna elements 242, 243, 244, 245, 246, and 248 are all disabled. Thus, the corresponding two transmission lines 231 and 237 are coupled in parallel (e.g., the parallel transmission lines have a total impedance value of 50Ω). Specifically, assuming that a first antenna element and a second antenna element are enabled, and the other antenna elements are disabled, the angle between a first straight line formed by connecting the first antenna element to the feeding point FP and a second straight line formed by connecting the second antenna element to the feeding point FP is substantially equal to 90 degrees. In other embodiments, by controlling the switch elements, the synthetic radiation beam of the antenna system 200 may be adjusted to be emitted toward different directions.

Figure 3:
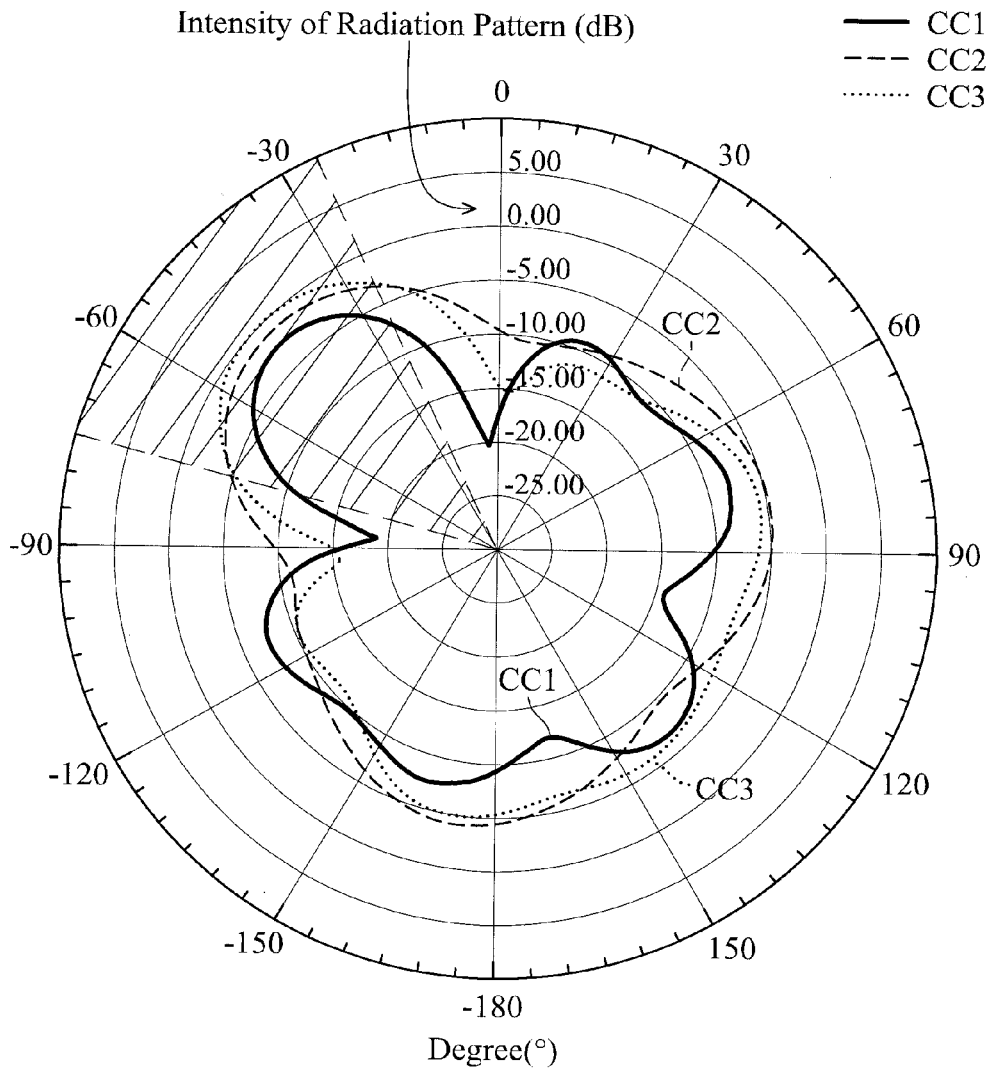
FIG. 3 is the radiation pattern of an antenna system performing signal transmission or reception according to an embodiment of the invention.

FIG. 3 is a radiation pattern of the antenna system 200 performing signal transmission or reception according to an embodiment of the invention. As shown in FIG. 3, a first curve CC1, a second curve CC2, and a third curve CC3 represent the radiation patterns measured at the elevation angles of 0, 30, and 90 degrees, respectively. According to the measurement of FIG. 3, when two nonadjacent antenna elements (e.g., the antenna elements 241 and 247) of the antenna system 200 are enabled, the main beam width of the antenna system 200 is from 50 to 55 degrees, providing relatively high directivity and a relatively high front-to-back ratio.

Figure 4:
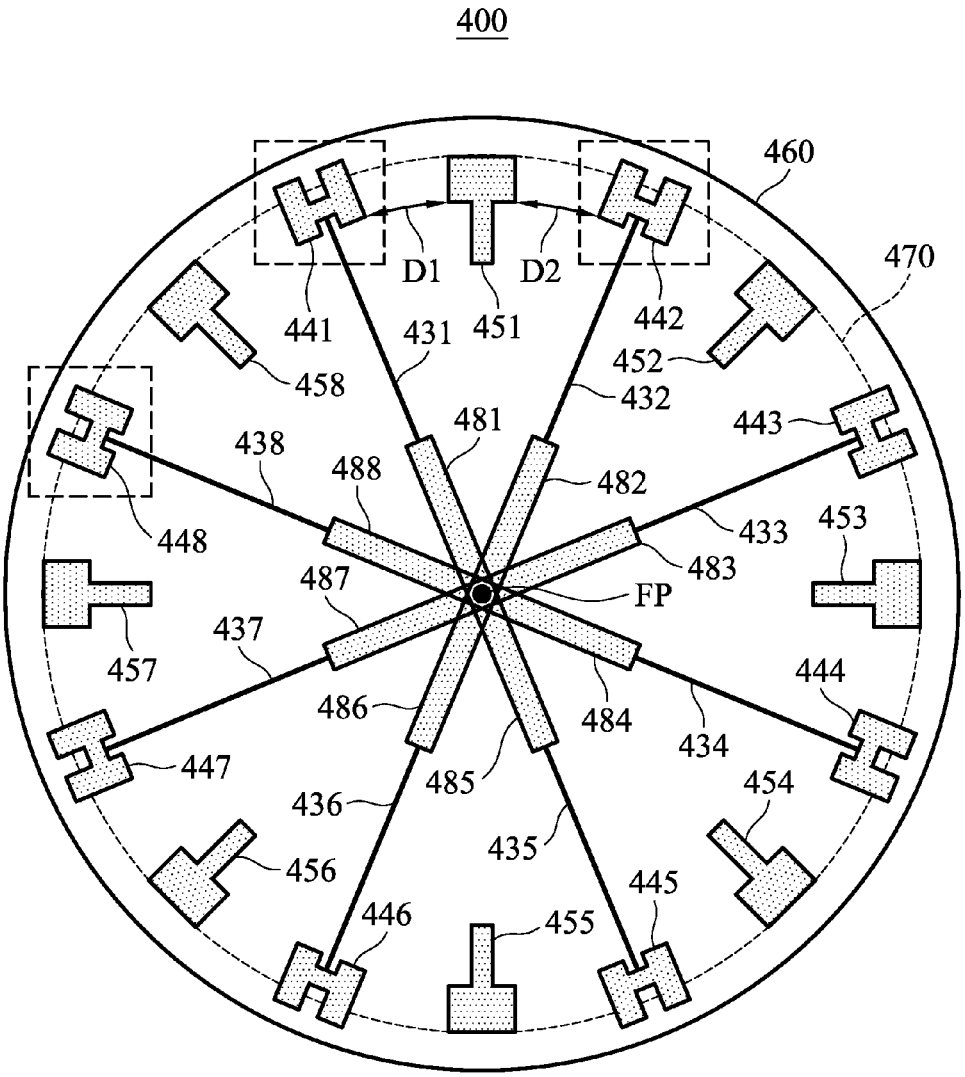
FIG. 4 is a diagram of an antenna system according to an embodiment of the invention.

FIG. 4 is a diagram of an antenna system 400 according to an embodiment of the invention. In the embodiment of FIG. 4, the antenna system 400 includes a signal source (not shown), a plurality of switch elements (not shown), a plurality of transmission lines 431, 432, . . . , and 438, a plurality of antenna elements 441, 442, . . . , and 448, a plurality of reflectors 451, 452, . . . , and 458, and a plurality of quarter-wavelength transformers 481, 482, . . . , and 488. The signal source is coupled to a feeding point FP. Each of the antenna elements 441, 442, . . . , and 448 is coupled through the respective one of the switch elements, the respective one of the transmission lines 431, 432, . . . , and 438, and the respective one of the quarter-wavelength transformers 481, 482, . . . , and 488 to the feeding point FP. For example, the antenna element 441 may be coupled through a corresponding switch element, the transmission line 431, and the quarter-wavelength transformer 481 to the feeding point FP. The switch elements are selectively closed or opened individually, so as to enable or disable the antenna elements 441, 442, . . . , and 448, respectively. The transmission lines 431, 432, . . . , and 438 may have the same lengths and the same impedance values. Each of the quarter-wavelength transformers 481, 482, . . . , and 488 is coupled to the respective one of the transmission lines 431, 432, . . . , and 438. For example, the quarter-wavelength transformer 481 may be coupled to the transmission line 431, and the quarter-wavelength transformer 482 may be coupled to the transmission line 432. Each of the quarter-wavelength transformers 481, 482, . . . , and 488 is configured to adjust the impedance value of a corresponding one of the transmission lines 431, 432, . . . , and 438, and the impedance values of the transmission lines 431, 432, . . . , and 438 are the same (e.g., the impedance value of the transmission line 431 adjusted by the quarter-wavelength transformer 481 may be 150Ω, and the impedance value of the transmission line 432 adjusted by the quarter-wavelength transformer 482 may also be 150Ω). The quarter-wavelength transformers 481, 482, . . . , and 488 reduce the difficulty of manufacturing high-impedance transmission lines. The reflectors 451, 452, . . . , and 458 are respectively coupled to a ground voltage. The reflectors 451, 452, . . . , and 458 are independent of the signal transmission paths of the antenna elements 441, 442, . . . , and 448. As shown in FIG. 4, each of the antenna elements 441, 442, . . . , and 448 has an H-shape, and each of the reflectors 451, 452, . . . , and 458 has a T-shape. The antenna elements 441, 442, . . . , and 448 are spaced at equal intervals around the circumference of a first circle 460, and the reflectors 451, 452, . . . , and 458 are spaced at equal intervals around the circumference of a second circle 470. The diameter of the second circle 470 is slightly shorter than the diameter of the first circle 460. Each of the reflectors 451, 452, . . . , and 458 is disposed between two respective adjacent antenna elements of the antenna elements 441, 442, . . . , and 448. For example, the reflector 451 may be disposed between two adjacent antenna elements 441 and 442, and the reflector 452 may be disposed between two adjacent antenna elements 442 and 443. The spacing D2 between each of the reflectors 451, 452, . . . , and 458 and a corresponding one of the antenna elements 441, 442, . . . , and 448 is from ⅛ to ⅓ wavelength of the operation frequency band of the antenna system 400. For example, the spacing D2 between the reflector 451 and the antenna element 441 (or the antenna element 442) may be from ⅛ to ⅓ wavelength of the operation frequency band of the antenna system 400. In the embodiment of FIG. 4, when the antenna system 400 performs signal transmission or reception, only three adjacent antenna elements of the antenna 441, 442, . . . , and 448 are enabled, so as to generate a narrow synthetic radiation beam. For example, only three adjacent antenna elements 441, 442, and 448 are enabled, and the other five antenna elements 443, 444, 445, 446, and 447 are disabled. Thus, the corresponding three transmission lines 431, 432 and 438 are coupled in parallel (e.g., the parallel transmission lines have a total impedance value of 50Ω). Specifically, it is assumed that a first antenna element, a second antenna element, and a third antenna element are enabled, and the other antenna elements are disabled. A first straight line is formed by connecting the first antenna element to the feeding point FP. A third straight line is formed by connecting the third antenna element to the feeding point FP. The angle between the first straight line and the third straight line is substantially equal to 90 degrees. In other embodiments, by controlling the switch elements, the synthetic radiation beam of the antenna system 400 may be adjusted to face different directions.

Figure 5:
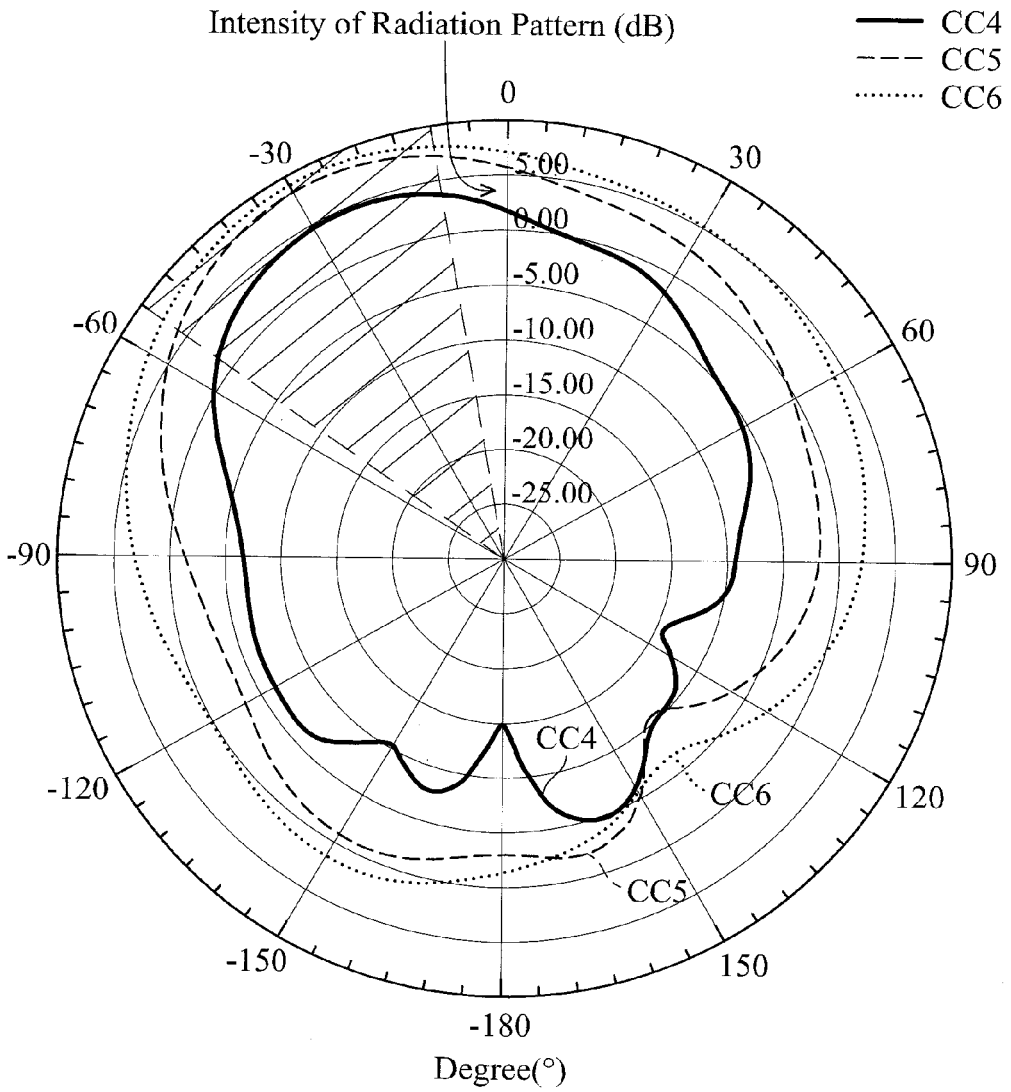
FIG. 5 is the radiation pattern of an antenna system performing signal transmission or reception according to an embodiment of the invention.

FIG. 5 is a radiation pattern of the antenna system 400 performing signal transmission or reception according to an embodiment of the invention. As shown in FIG. 5, a fourth curve CC4, a fifth curve CC5, and a sixth curse CC6 represent the radiation patterns measured at the elevation angles of 0, 30, and 90 degrees, respectively. According to the measurement of FIG. 5, when three adjacent antenna elements (e.g., the antenna elements 441, 442, and 448) of the antenna system 400 are enabled, the main beam width of the antenna system 400 is from 45 to 50 degrees, providing relatively high directivity and a relatively high front-to-back ratio.

Figure 6:
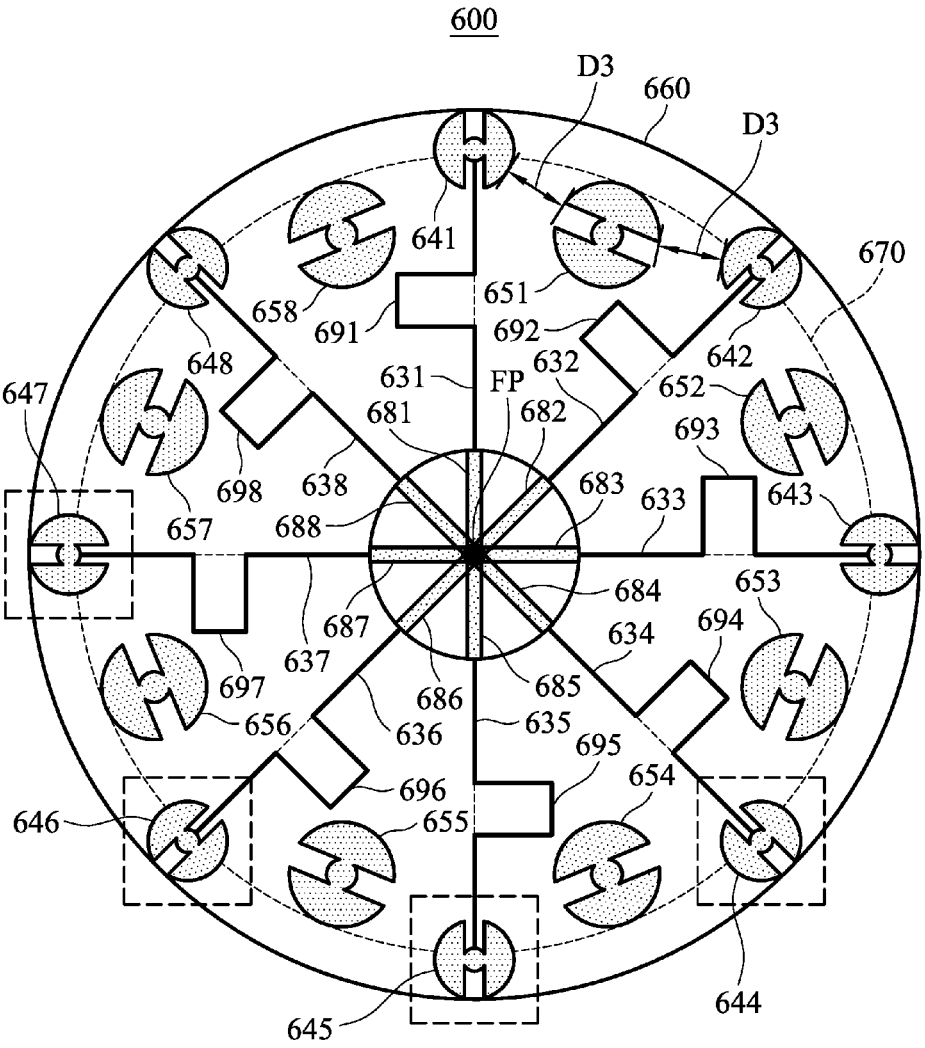
FIG. 6 is a diagram of an antenna system according to an embodiment of the invention.

FIG. 6 is a diagram of an antenna system 600 according to an embodiment of the invention. In the embodiment of FIG. 6, the antenna system 600 includes a signal source (not shown), a plurality of switch elements (not shown), a plurality of transmission lines 631, 632, . . . , and 638, a plurality of antenna elements 641, 642, . . . , and 648, a plurality of reflectors 651, 652, . . . , and 658, a plurality of quarter-wavelength transformers 681, 682, . . . , and 688, and a plurality of phase delay lines 691, 692, . . . , and 698. The signal source is coupled to a feeding point FP. Each of the antenna elements 641, 642, . . . , and 648 is coupled through the respective one of the switch elements, the respective one of the transmission lines 631, 632, . . . , and 638, the respective one of the phase delay lines 691, 692, . . . , and 698, and the respective one of the quarter-wavelength transformers 681, 682, . . . , and 688 to the feeding point FP. For example, the antenna element 641 may be coupled through a corresponding switch element, the transmission line 631 the phase delay line 691, and the quarter-wavelength transformer 681 to the feeding point FP. The switch elements are selectively closed or opened individually, so as to enable or disable the antenna elements 641, 642, . . . , and 648, respectively. The transmission lines 631, 632, . . . , and 638 may have the same lengths and the same impedance values. Each of the quarter-wavelength transformers 681, 682, . . . , and 688 is coupled to the respective one of the transmission lines 631, 632, . . . , and 638. For example, the quarter-wavelength transformer 681 may be coupled to the transmission line 631, and the quarter-wavelength transformer 682 may be coupled to the transmission line 632. Each of the quarter-wavelength transformers 681, 682, . . . , and 688 is configured to adjust the impedance value of a corresponding one of the transmission lines 631, 632, . . . , and 638, and the impedance values of the transmission lines 631, 632, . . . , and 638 are the same (e.g., the impedance value of the transmission line 631 adjusted by the quarter-wavelength transformer 681 may be 200Ω, and the impedance value of the transmission line 632 adjusted by the quarter-wavelength transformer 682 may also be 200Ω). The quarter-wavelength transformers 681, 682, . . . , and 688 reduce the difficulty to manufacture high-impedance transmission lines. Each of the phase delay lines 691, 692, . . . , and 698 can switch between its first path (i.e., a bending solid line in the figure) and its second path (i.e., a straight dashed line in the figure) coupled in parallel. The first path has tunable phase delay (e.g., from 80 to 130 degrees), and the second path has no phase delay. Each of the phase delay lines 691, 692, . . . , and 698 selects either its first path or its second path by using a respective RF (Radio Frequency) switch (not shown) to connect its first path (i.e., a bending solid line in the figure) or its second path (i.e., a straight dashed line in the figure) to the respective one of the transmission lines 631, 632, . . . , and 638. The phase delay lines 691, 692, . . . , and 698 are configured to adjust the feeding phases of the antenna elements 641, 642, . . . , and 648. The reflectors 651, 652, . . . , and 658 are respectively coupled to a ground voltage. The reflectors 651, 652, . . . , and 658 are independent of the signal transmission paths of the antenna elements 641, 642, . . . , and 648. As shown in FIG. 6, each of the antenna elements 641, 642, . . . , and 648 has an H-shape, and each of the reflectors 651, 652, . . . , and 658 has a H-shape. The antenna elements 641, 642, . . . , and 648 are spaced at equal intervals around the circumference of a first circle 660, and the reflectors 651, 652, . . . , and 658 are spaced at equal intervals around the circumference of a second circle 670. The diameter of the second circle 670 is slightly shorter than the diameter of the first circle 660. Each of the reflectors 651, 652, . . . , and 658 is disposed between two respective adjacent antenna elements of the antenna elements 641, 642, . . . , and 648. For example, the reflector 651 may be disposed between two adjacent antenna elements 641 and 642, and the reflector 652 may be disposed between two adjacent antenna elements 642 and 643. The spacing D3 between each of the reflectors 651, 652, . . . , and 658 and a corresponding one of the antenna elements 641, 642, . . . , and 648 is from ⅛ to ⅓ wavelength of the operation frequency band of the antenna system 600. For example, the spacing D3 between the reflector 651 and the antenna element 641 (or the antenna element 642) may be from ⅛ to ⅓ wavelength of the operation frequency band of the antenna system 600. In the embodiment of FIG. 6, when the antenna system 400 performs signal transmission or reception, only four adjacent antenna elements of the antenna elements 641, 642, . . . , and 648 are enabled, so as to generate a narrow synthetic radiation beam. For example, only four adjacent antenna elements 644, 645, 646, and 647 are enabled, and the other fourth antenna elements 641, 642, 643, and 648 are disabled. Thus, the corresponding four transmission lines 634, 635, 636, and 637 are coupled in parallel (e.g., the parallel transmission lines have a total impedance value of 50Ω). In addition, the two corresponding phase delay lines 695 and 696 each generate phase delay from 80 to 130 degrees, and they suppress the leading transmission phases of the antenna elements 645 and 646 (because the antenna elements 645 and 646 are positioned in front of the antenna elements 644 and 647). Specifically, it is assumed that a first antenna element, a second antenna element, a third antenna element, and a fourth antenna element are enabled, and the other antenna elements are disabled. A first straight line is formed by connecting the first antenna element to the feeding point FP. A fourth straight line is formed by connecting the fourth antenna element to the feeding point FP. The angle between the first straight line and the fourth straight line is substantially equal to 135 degrees. In other embodiments, by controlling the switch elements, the synthetic radiation beam of the antenna system 600 may be adjusted to face different directions.

Figure 7:
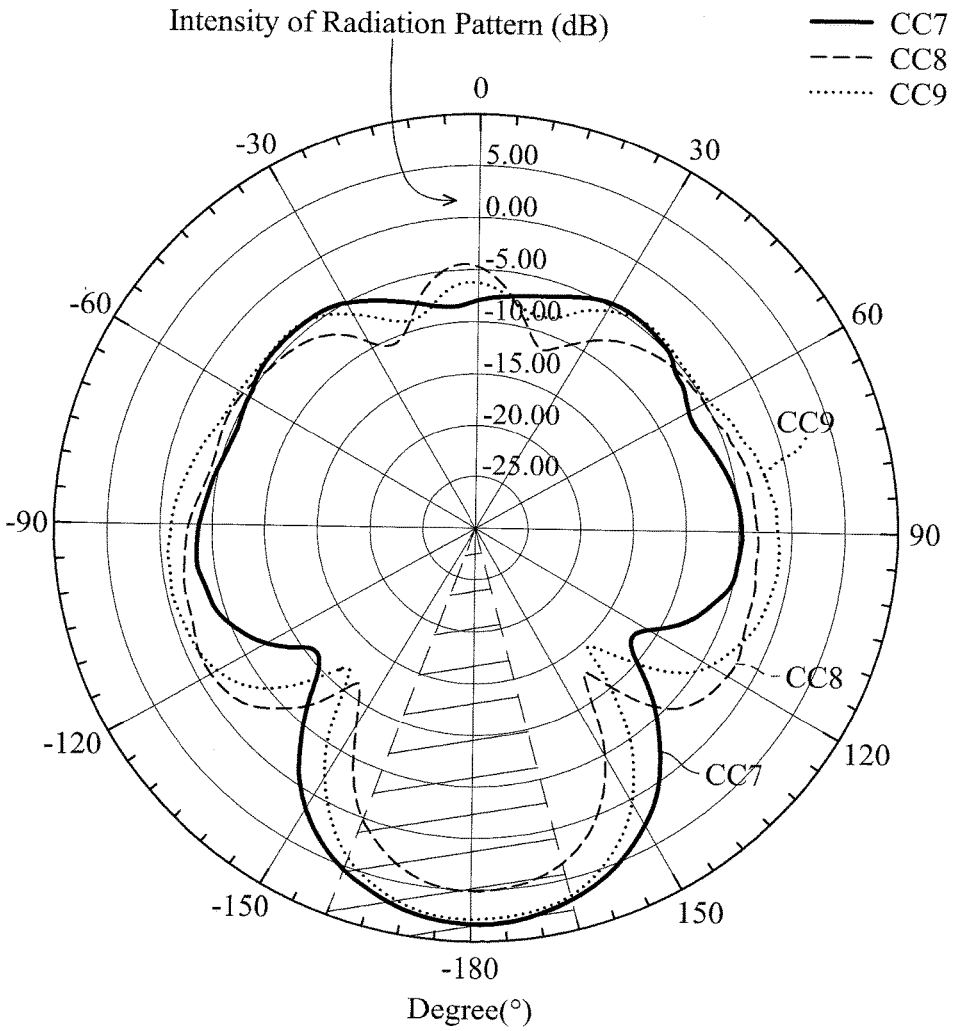
FIG. 7 is the radiation pattern of an antenna system performing signal transmission or reception according to an embodiment of the invention.

FIG. 7 is a radiation pattern of the antenna system 600 performing signal transmission or reception according to an embodiment of the invention. As shown in FIG. 7, a seventh curve CC7, an eighth curve CC8, and a ninth curve CC9 represent the radiation patterns measured at the elevation angles of 0, 30, and 90 degrees, respectively. According to the measurement of FIG. 7, when four adjacent antenna elements e.g., the antenna elements 644, 645, 646, and 647) of the antenna system 600 are enabled, the main beam width of the antenna system 600 is about 37 degrees, providing relatively high directivity and a relatively high front-to-back ratio.

Figure 8:
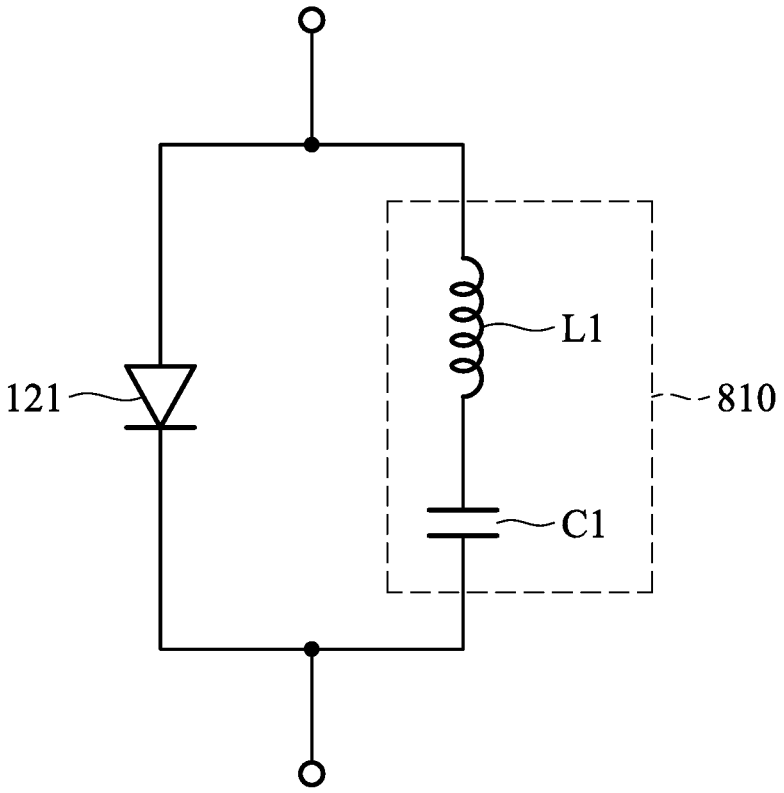
FIG. 8 is a diagram of a resonant circuit according to an embodiment of the invention.

FIG. 8 is a diagram of a resonant circuit 810 according to an embodiment of the invention. The resonant circuit 810 is configured to improve the performance of a switch element. In the embodiment of FIG. 1 and FIG. 8, the antenna system 100 further includes a plurality of resonant circuits. Each of the resonant circuits is coupled in parallel with the respective one of the switch elements 121, 122, . . . , and 128. For example, the switch element 121 may be coupled in parallel with the resonant circuit 810. The resonant circuit 810 includes a capacitor C1 and an inductor L1 coupled in series, and its resonant frequency is from about 2400 MHz to about 2500 MHz (e.g., 2450 MHz). When the switch element 121 is opened, the capacitor C1 resonates with the inductor L1 so as to form a perfect open circuit, and therefore the corresponding antenna element 141 is completely disabled. It should be understood that the resonant circuit 810 of FIG. 8 may be applied to each switch element of the antenna systems 200, 400, and 600.

The invention proposes an antenna system with high directivity. By appropriately enabling partial antenna elements and disabling the other antenna elements, the antenna system of the invention can generate a relative narrow main radiation beam toward a specific direction, which is adjustable. The invention is used to enhance the position function of wireless access point, and it is suitable for application in different environments, such as homes or hypermarkets.

Note that the above element sizes, element parameters, element shapes, and frequency ranges are not limitations of the invention. An antenna engineer can adjust these settings or values according to different requirements. It should be understood that the antenna system of the invention is not limited to the configurations of FIGS. 1-8. The invention may merely include any one or more features of any one or more embodiments of FIGS. 1-8. In other words, not all of the features shown in the figures should be implemented in the antenna system of the invention.

Use of ordinal terms such as "first", "second", "third", etc., in the claims to modify a claim element does not by itself connote any priority, precedence, or order of claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna system, comprising:

a signal source, coupled to a feeding point;

a plurality of antenna elements, wherein the antenna elements cover a same operation frequency band, each of the antenna elements is coupled through one of a plurality of switch elements and one of a plurality of transmission lines to the feeding point, and the switch elements are selectively closed or opened individually; and a plurality of reflectors, wherein each of the reflectors is configured to reflect the electromagnetic wave from one of the antenna elements;

wherein the spacing between each of the reflectors and a corresponding one of the antenna elements is from ⅛ to ⅓ wavelength of the operation frequency band;

wherein the antenna elements are spaced at equal intervals around a circumference of a first circle;

wherein the reflectors are spaced at equal intervals around a circumference of a second circle, and a diameter of the second circle is shorter than a diameter of the first circle.

2. The antenna system as claimed in claim 1, wherein a total number of antenna elements is 8, a total number of switch elements is 8, a total number of transmission lines is 8, and a total number of reflectors is 8.

3. The antenna system as claimed in claim 1, wherein the switch elements are PIN diodes.

4. The antenna system as claimed in claim 1, wherein the operation frequency band is from 2400 MHz to 2500 MHz.

5. The antenna system as claimed in claim 1, wherein the spacing between each of the reflectors and the corresponding one of the antenna elements is ¼ wavelength of the operation frequency band.

6. The antenna system as claimed in claim 1, wherein each of the antenna elements, a corresponding one of the reflectors, and the feeding point are aligned in a straight line.

7. The antenna system as claimed in claim 1, wherein each of the antenna elements has an H-shape, and each of the reflectors has a straight-line shape.

8. The antenna system as claimed in claim 7, wherein only two nonadjacent antenna elements of the antenna elements are enabled, so as to generate a narrow synthetic radiation beam.

9. The antenna system as claimed in claim 1, wherein each of the reflectors is disposed between two respective adjacent antenna elements of the antenna elements.

10. The antenna system as claimed in claim 1, wherein each of the antenna elements has an H-shape, and each of the reflectors has a T-shape.

11. The antenna system as claimed in claim 10, wherein only three adjacent antenna elements of the antenna elements are enabled, so as to generate a narrow synthetic radiation beam.

12. The antenna system as claimed in claim 1, further comprising:

a plurality of phase delay lines, wherein each of the phase delay lines is coupled to one of the transmission lines.

13. The antenna system as claimed in claim 1, further comprising:

a plurality of quarter-wavelength transformers, wherein each of the quarter-wavelength transformers is coupled to one of the transmission lines.

14. The antenna system as claimed in claim 1, wherein each of the antenna elements has an H-shape, and each of the reflectors has an H-shape.

15. The antenna system as claimed in claim 14, wherein only four adjacent antenna elements of the antenna elements are enabled, so as to generate a narrow synthetic radiation beam.

16. The antenna system as claimed in claim 1, further comprising:

a plurality of resonant circuits, wherein each of the resonant circuits is coupled in parallel with one of the switch elements.

17. The antenna system as claimed in claim 16, wherein each of the resonant circuits comprises a capacitor and an inductor coupled in series.

* * * * *